United States Patent [19]

Dürrfeld

[11] Patent Number: 4,465,405

[45] Date of Patent: Aug. 14, 1984

[54] METHOD AND DEVICE FOR THE BACKFILLING OF ROADWAY SUPPORTS IN MINE AND TUNNEL CONSTRUCTION WITH THE AID OF SUPPORT HOSES HAVING A HARDENING FILLER

[75] Inventor: Werner Dürrfeld, Herten, Fed. Rep. of Germany

[73] Assignee: GTG Gesteins- und Tiefbau GmbH, Fed. Rep. of Germany

[21] Appl. No.: 368,175

[22] Filed: Apr. 14, 1982

[30] Foreign Application Priority Data

Apr. 29, 1981 [EP] European Pat. Off. ..... 81103227.5

[51] Int. Cl.[3] ..... E21D 11/18; E01G 5/16

[52] U.S. Cl. ..... 405/289; 405/150; 405/288; 405/132

[58] Field of Search ..... 405/150, 232, 233, 288, 405/289, 146, 138, 132; 299/11

[56] References Cited

U.S. PATENT DOCUMENTS

| | | | |
|---|---|---|---|
| 3,396,545 | 8/1968 | Lamberton | 405/233 |
| 3,509,725 | 5/1970 | Schnabel | 405/150 |
| 3,750,407 | 8/1973 | Heierli et al. | 405/138 |

FOREIGN PATENT DOCUMENTS

| | | | |
|---|---|---|---|
| 2734717 | 2/1978 | Fed. Rep. of Germany | 299/11 |
| 685831 | 9/1979 | U.S.S.R. | 405/146 |

*Primary Examiner*—Dennis L. Taylor

*Attorney, Agent, or Firm*—Remy J. VanOphem

[57] ABSTRACT

The invention relates to a process and device for backfilling of a roadway structure of mine and tunnel construction utilizing support hoses filled with a hardening filler. The hoses, when empty, are supported by the roadway support, after being put in place on the support are filled and thereby stretched out to form an inflated profile which locks onto the support section. The process and device used has the advantages of not being limited to certain specific support structure spacings and may be applied to a variety of roadway sections. The support section has the general shape of an I-beam and when used in multi-part roadway structures the section junctions are protected against overloads even when they are designed with limited yieldability. The support hose is laid on and supported over part of its length directly by the outer face of an "I" beam support section flange facing the rock. Where the flange supports the hose, the support section flange wholly or partly indents the cross-section contour of the inflated profile when the support hose is stretched out as it is filled with the hardener compound.

22 Claims, 15 Drawing Figures

FIG. 1
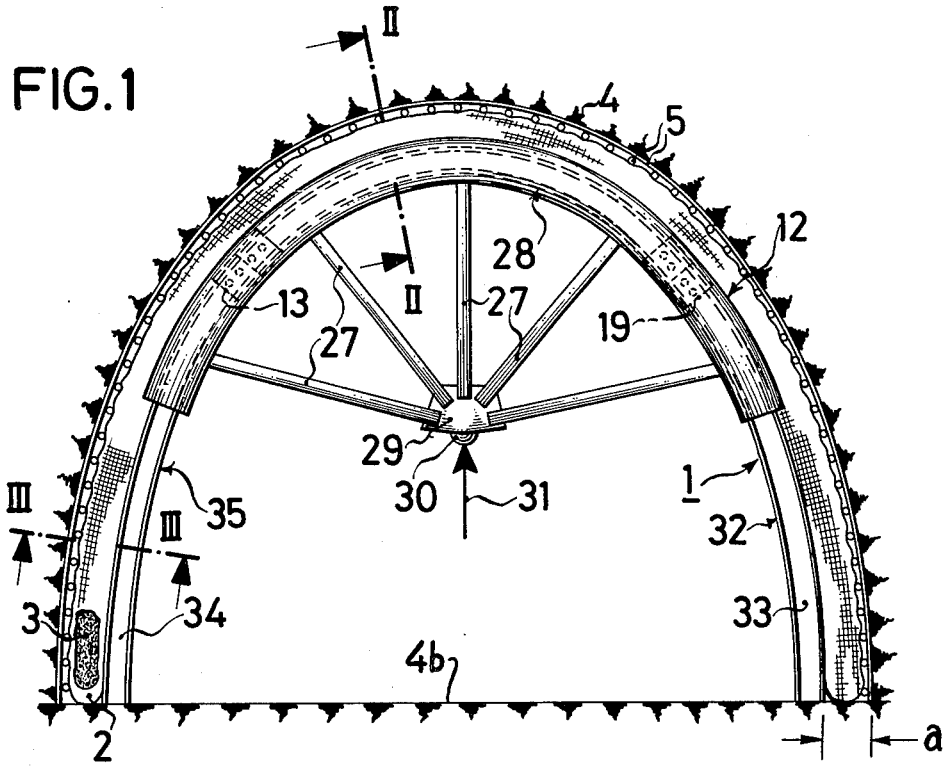
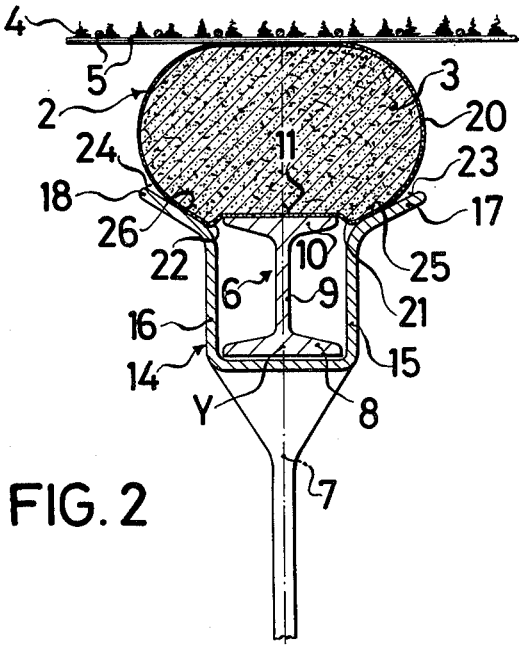
FIG. 2

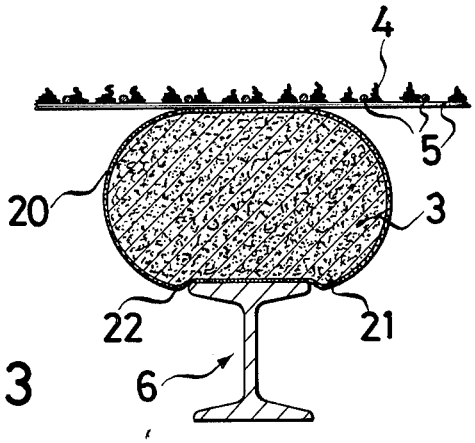
FIG. 3
FIG. 4
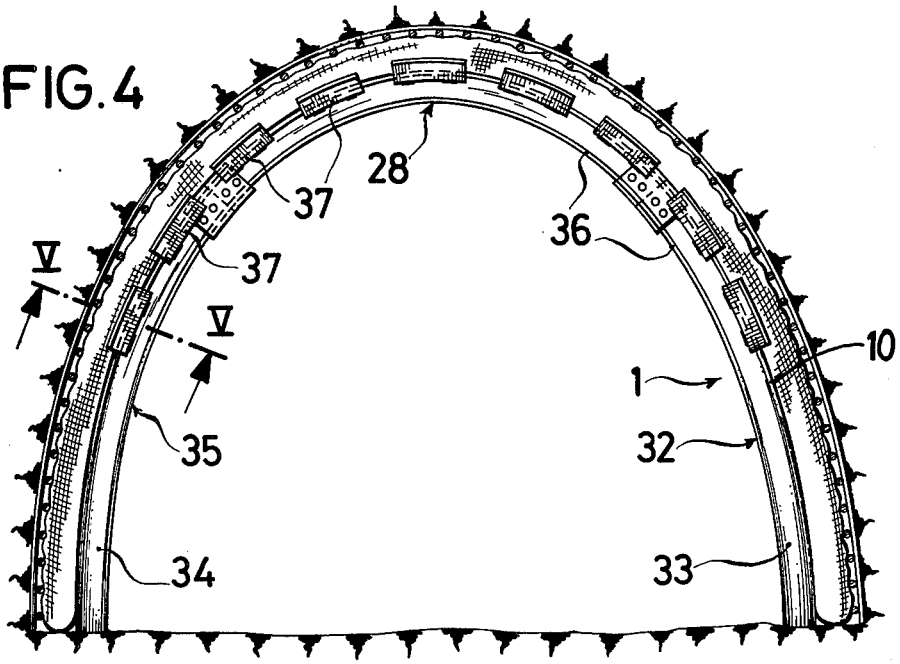

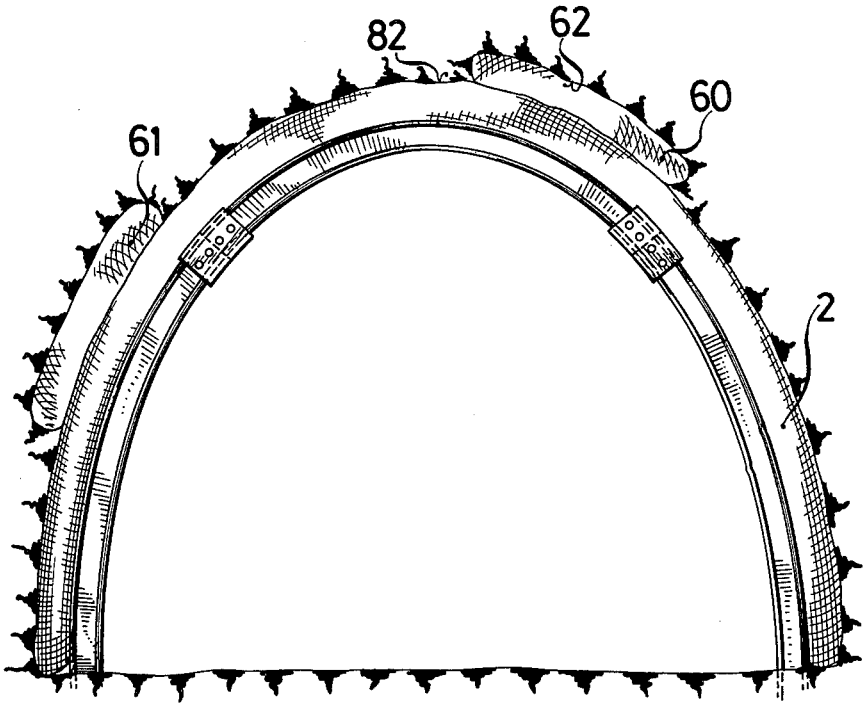
FIG. 8
FIG. 9
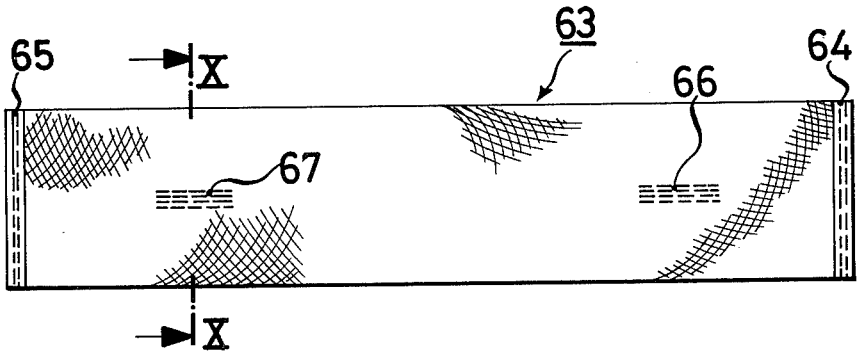

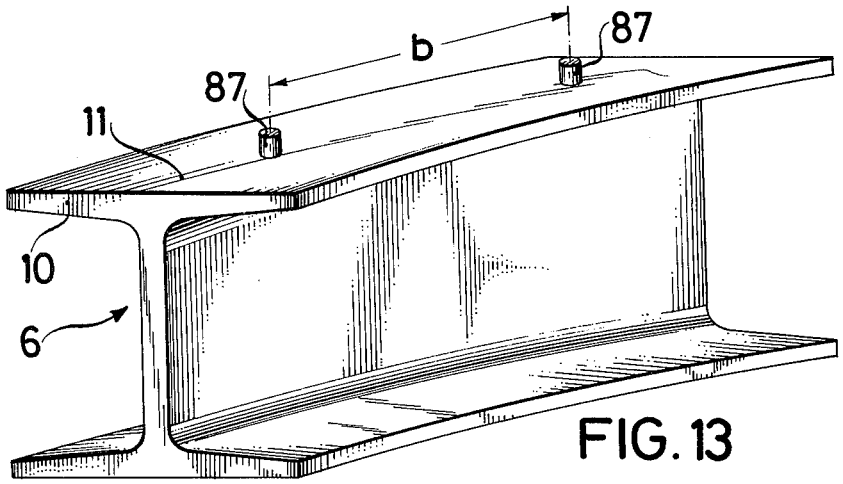
FIG. 13
FIG. 14
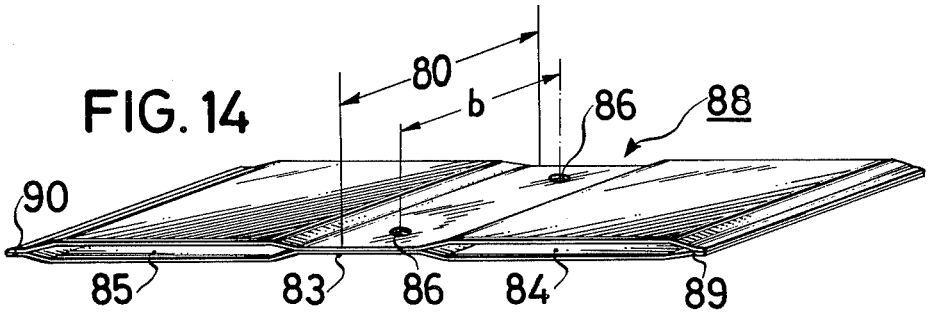
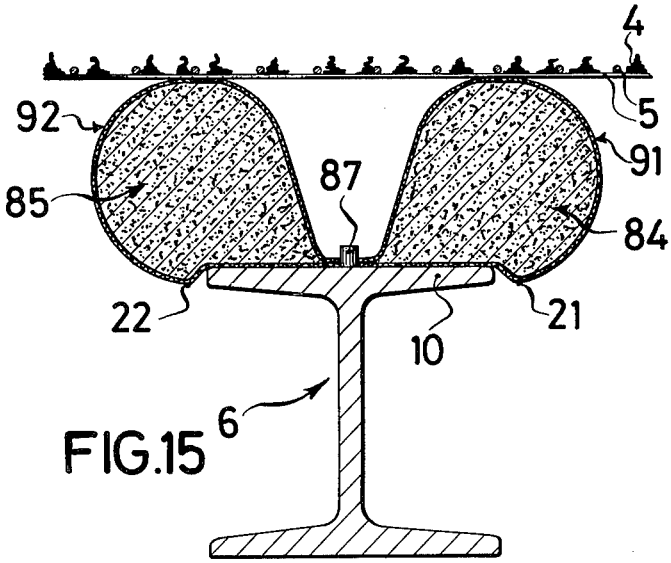
FIG.15

METHOD AND DEVICE FOR THE BACKFILLING OF ROADWAY SUPPORTS IN MINE AND TUNNEL CONSTRUCTION WITH THE AID OF SUPPORT HOSES HAVING A HARDENING FILLER

BACKGROUND OF THE INVENTION

The invention primarily concerns a method for backfilling roadway supports in mine and tunnel constructions. The method utilizes the aid of support hoses filled with a hardening filling. The support hoses, in their empty state, are laid on the roadway support and subsequently filled with the hardener whereby they are inflated to a form locking profile with the roadway support.

The invention also relates to devices for carrying out this process with the use of a support hose made of water-permeable material, in particular textiles, which retain fine-grained components of the filler.

Generally, backfilling of roadway supports serves to avoid concentrated stress point loads by the rock on the roadway supports. This presumes that each roadway support on its periphery is abutted as far as possible directly against the rock surface through the backfilling; the rock surface is usually not excavated in exactly the same profile as the roadway, therefore the above presumption is highly unlikely to exist. The invention concerns the use of a hardening compound, preferably hydraulic filling compounds, which are pumped under considerable pressure, e.g. of 15 bar, as fluids into support hoses placed between the support sections and the rock formation in the area to be backfilled. The support hose, as it is filled with the hardening compound insures that the various gaps to the respective road supports are bridged, and at the same time connects the support section in a form locking relationship with the inflated profile of the support hose. In turn, the inflated profile of the support hose presses against the excavated rock surface or against a roadway lagging, which may be installed between the support hose and the rock formation and which is pressed against the rock as the support hose is pressurized with the filling.

Previously, this kind of backfilling technique could only be executed with U-channel iron sections. In that type of construction, the support hose is laid empty into the channel iron and is expanded into an inflated profile which rests on the bottom of the channel and in cross-section forms a lock between the bottom of the channel and both webs of the section. However, channel iron sections of this type are suitable only for yieldable roadway supports, as these consist of several sections therefore the channel iron sections must be joined together by placing one into the other and they must be braced yieldably to pressure in order to maintain the proper relationship. This does require special measures in order to form breaking points in the hardened filler in the area of the joints to allow the backfilling to yield sufficiently for the insertion of the sections.

This type of roadway support is part of the previously disclosed state of the art, German Pat. No. 26 27 256. The empty hose is inserted passing under the pressure yielding tension joints and into the bottom of the channel section. When the support hose is inflated, it will unfold completely to its desired inflated profile, producing the connection to the rock formation whereas between the overlapping zones of the sections, the hose is constricted to form the rated breaking points which make the insertion possible. It is a disadvantage that the overlapping zones cannot contact the rock. This portion can therefore give way when the roadway support is placed under excessive pressure, and it could distort the support to the extent that it can no longer provide the intended support. Further, channel sections are relatively expensive and can only be used where their great flexibility can be used to good advantage. These fields of use do not coincide with the much broader application of backfilling with the use of support hoses and hardening filler materials.

It has been known to use roadway supports which utilize yieldable supports as preliminary supports, such that when the yieldable supports are removed, contact is made with the rock by pillow-shaped hoses, which may also be inflated with a hardening filler as shown in Swiss Pat. No. 462 871. This type of support is recovered by dropping the pressure-yielding supports, thereby leaving a peripheral space with the support hoses or pillows and, accordingly, is limited in its recovery capabilities. For this kind of construction the support hoses must be common to two adjacent supports if they are merely laid onto the supports prior to being filled. Therefore only large volume hoses can be used in conjunction with small roadway support spacings, as occurs locally in crumbling rock.

The invention, however, has for its objective the task of applying the previously known back filling technique, which is not limited to specific support spacings, to generally I-beam shaped support sections used in multi-section roadway supports in conjunction with support hoses of known construction able to bridge spaces of approximately 25 cm. and are therefore relatively small in volume, and further to protect the joints between the sections against overload even if they are of limited yieldability.

According to the invention, this objective is attained by the identifying characteristics of the patent claims.

By directly placing and supporting the support hose onto the outer surface of a support flange which faces the rocks, the generally I-beam shaped roadway supports can be installed, in spite of the support hose, so that they are used in the principal load bearing plane or so-called y-axis of the support plane, their primary bending direction. The vertical support which was previously provided by the upright rocks of a U-shaped channel is now accomplished by allowing the support hose in its inflated form to extend over both sides of the top flange of the I-beam support thereby allowing the flange to indent the flexible support hose as it is filled and create a form locking indentation on each side of the flange of the I-beam support section upon which the support hose is laid. It is to be understood that this construction need only be used as desired in practical applications.

The invention therefore has the advantage of being able to place the support hoses also across the area of the support section joints and therefore also establishing a connection between these areas and the rock as well as joining the remainder of the periphery with the rocks. The joint sections are therefore not placed under excessive stress which avoids permanent deformation of the roadway support.

Usually the required lengths of hose are rolled off, e.g., a drum or a bobbin at the construction site, and the hose is then laid on the previously erected roadway support. Depending on the material, this kind of hose is resilient and, as the filler is introduced, it shapes itself not only from its original flat state into the cross-section of the inflated profile, but also within itself. It is therefore recommended, according to a preferred embodiment of the invention, to proceed in a way as to restrict the support hose in a manner that allows the hose limited lateral movement on the support flange while it is being filled. Thereby the hose can, for instance, move freely in its axis as it inflates until it has bridged the space, i.e. the gap to the rock formation.

It has been found that, contrary to prior experience with the U-shaped channel sections, mounting of the hose allowing limited movement does not need to extend over the full length of the support hose when using the hose in conjunction with an I-beam section flange, even though the bearing surface there is comparatively limited. For this reason, according to a further feature of the invention, the limited mobility of the support hose movement may extend over only portions of the support hose. The remaining portions of the support hose may be arranged to be freely movable. This method is of considerable advantage as it facilitates hose placement and, in particular, as it reduces the number or lengths of the auxiliary devices which need be provided on the support section for holding of the support hose on the I-beam support sections.

A further embodiment of the invention may also be realized, according to which the hose is form locked to the flange of the I-beam section in the area where its movement is restricted. The required devices can be spaced appropriately. The results of selective placement of this type of form lock means that parts of the form-fitting connections need only be provided on the support section and on the hose itself, so that auxiliary holding devices may be dispensed with.

It will not always be possible to adequately bridge all gaps in such a way as to form a contact with the rock as well as a form lock between the support hose and the I-beam support.

In particular, this may occur where unintended additional excavation was done due to teary rock or inadequate excavation. The method, according to the invention which is then practiced, is to establish a connection to the rock or the lagging by placing one or several short hoses on the side of the support hose facing the rock.

Here, too, the deformation occurring when the short hoses are filled can, without any additional mounting, be prevented from causing the short hoses to slip off or to deviate from the intended position without the use of additional mounting devices. For this purpose the method according to the invention provides that the short hoses are inflated at least on a portion of their length into a double bead, with which it is centered on the supporting hose.

According to an additional embodiment of the invention, one can proceed by placing the short hoses onto the supporting hose with a transverse fold, which is utilized as spare material when the respective hose is inflated.

BRIEF DESCRIPTION OF THE DRAWINGS

In the following, detailed description the invention is explained the way of several exemplary embodiments; illustrated in the drawing, wherein:

FIG. 1 shows a first exemplary embodiment in which a roadway support is shown according to the invention described.

FIG. 2 is a cross-sectional view taken along the line II—II of FIG. 1;

FIG. 3 is a cross-sectional view taken along the line III—III of FIG. 1;

FIG. 4 shows another exemplary embodiment of the invention in a view corresponding to FIG. 1;

FIG. 8 is yet another exemplary embodiment of the invention in a view corresponding to FIGS. 1 and 4;

FIG. 9 is a top-view of a short support hose as used in the embodiment according to FIG. 8;

FIG. 13 is a perspective view of a roadway support section with a device to attach the form locking hose to the roadway support;

FIG. 14 is a perspective view of a support hose used for the roadway section shown in FIG. 13; and FIG. 15 is a cross-sectional view of the support hose of FIG. 14 mounted to the roadway support structure according to FIG. 13.

DETAILED DESCRIPTION OF THE PREFERRED EMBODIMENT

Figure 5:
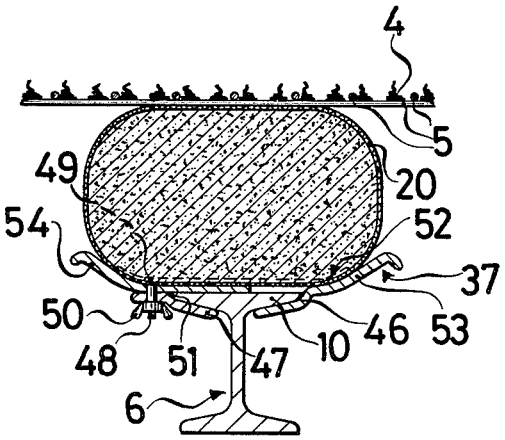
FIG. 5 is a cross-sectional view taken along the line V—V of FIG. 4.

According to the representations in FIGS. 1 and 2, a support hose 2, which is filled under pressure with an hardening compound 3, rests on an arch-shaped roadway support generally identified as 1 which, in turn, rests on the lower surface or floor **4*b* of an excavated tunnel. The support hose surrounds the entire outer periphery of the roadway support 1 and therefore also the two strap or butt joints, indicated at 13 and 19, joining the ends of each of the three sections 28, 32 and 35 which make up the roadway support 1. The support hose 2 bridges a gap or spacing of varying width of, for example, up to 25 cm. between the roadway support 1 and the lagging 5 pressed onto the upper arcuate surface 4*a* of the excavated tunnel. The spacing or gap exists along the entire periphery of the roadway support 1** and is designated by the reference character a.

The roadway support is an I-section or roadway support beam 6, the y axis of which is arranged in the support plane, indicated as 7 in FIG. 2 by the dot-dash line. Accordingly, the roadway support beam 6 has a flange 8 facing toward the interior of the arch-shaped roadway support, a flange 10 facing the rock formation 4 and a web 9 therebetween. The flange 10 has an outer surface 11 facing the rock, on which the support hose 2 is placed. When the support hose 2 is initially laid on the surface 11, it is yet to be filled as it is placed on the roadway support 1 as a flat tube or hose (not shown). The support hose 2 in its deflated state (not shown) is supported along the entire periphery of the roadway support 1.

In order to prevent the hose from slipping off during the subsequent filling of the hose with the hardening filler, a centering arch 12 is used while the hardener is pumped into the support hose 2. According to the representation in FIG. 2, the arch consists of a generally U-shaped channel section 14 with webs 15 and 16 surrounding the I-section beam 6 and angled outwardly at the free ends 17 or 18 thereof. The angled ends form a mounting for the support hose 2 while it is filled with the hardener. During the pumping of the hardener into the hose, the free ends permit lateral movement of the support hose, but this movement is limited in both directions transverse to the plane of the roadway support 1. As can be seen in FIG. 2, the support hose 2 is expanded to the inflated profile shown at 20 as the hardener filler is pumped in under the requisite pressure. The filler may be pumped into the hose at one or both ends. It may also be injected at any point along the hose by probes which may be inserted into the hose material at any desired point. The inflated profile of the hose forms indentations as shown at 21 and 22, by means of which the flange of the I-section beam partly indents the cross-sectional contour of the inflated profile. This results in a form locking joint between the I-section beam 6 and the support hose 2. The support hose, as it is filled with the hardener, also contacts the insides 23 and 24 of the outwardly angled free ends 17 and 18, as shown in the cross-section in FIG. 2, and is flattened there, as indicated diagrammatically at 25 and 26.

The centering arch 12 is braced at several locations along the arch, to the center, as shown, for instance, at 27 in FIG. 1. The strut end of the braces are attached to a gusset plate 29 at the bottom of which a hemisphere 30 is formed, which can be supported by an appropriate support schematically indicated by an arrow 31. Since the centering arch is only needed for a short time, that is, until the hose filling hardens, it is also possible to support the centering arch 12, with the aid of any loading equipment or vehicle that may be used to remove the raw debris in the roadway excavation.

In the regions where the support hose is not supported by the centering arch, as on the relatively straight ends 33 or 34 of the arched girder, the support hose forms the cross-sectional shape seen, for instance, in FIG. 3. Here again, by selecting an appropriate inflatable profile, a form lock results at 21 and 22 between the fully-inflated profile 20 and the I-section beam 6. It is not important to obtain this form lock, indicated diagrammatically at 21 and 22 along the entire length of the support hose. It is merely sufficient to attain an adequate locking between the hose and the I-section beam 6 and to preclude the otherwise possible separation of the I-section beam 6 and the support hose 2, under the influence of any displacement forces.

Thus, it is also possible to mount the hose as seen in the cross-section of FIG. 3 without any special devices surrounding the I-section beam 6. In such case, localized slippage by the support hose 2 as it moves during filling can be corrected by hand until the form-locking of the support hose 2 to the rock 4 and/or the I-section beam 6 has been achieved.

Figure 6:
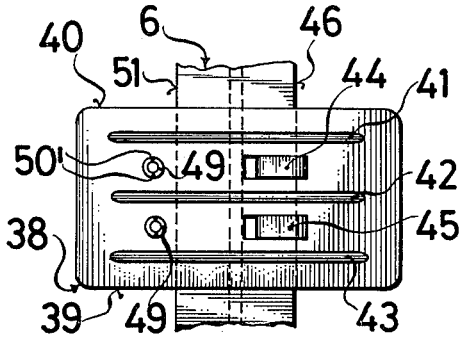
FIG. 6 is a partial top-view of the object of FIG. 5, but omitting the support hose.

In the embodiment according to FIG. 4, the support hose is supported in the region of the arch 36, i.e. above the relatively straight sections 33 and 34 by several butt straps 37 attached to the I-section beam 6 at spaced intervals. At the spaced intervals between the straps, the support hose is placed onto and supported directly by the upper flange 10 of the I-section beam 6, as shown in the exemplary embodiment in FIG. 3. As shown in the embodiment according to FIGS. 4 and 5, the exemplary butt straps are stamped out of ordinary steel plate. The straps are each a rectangular base plate 38, which as shown in FIG. 6, parallel to its longer edges 39 and 40 is provided with several beads 41, 42 and 43 and tongues 44 and 45 intermediate the beads. The tongues engage the underside of the longitudinal edge 46 of the upper flange 10, which faces the rock. Opposite tongues 47, which are detachably mounted, are installed on the opposite side of the upper flange 10 for reasons of safety. The opposite tongues 47 are attached with bolts 48, the heads 49 of which are attached to the base plate 38, as shown at 50' in FIG. 6, and wing nuts 50 braced on the opposite tongues 47, which in turn engage the opposite longitudinal edge 51 of the upper flange 10.

The base plate 38, when completely assembled, resembles the shape of a shallow trough 52 that opens toward the rock formation 4 or the lagging 5. In the area of the butt straps 37, the support hose 2 is therefore not supported by the outside of the upper flange 10 of the I-section beam, but by the butt straps 37, which prevent the hose from slipping from the support surface in either direction due to the shaped ends 53 and 54.

Figure 7:
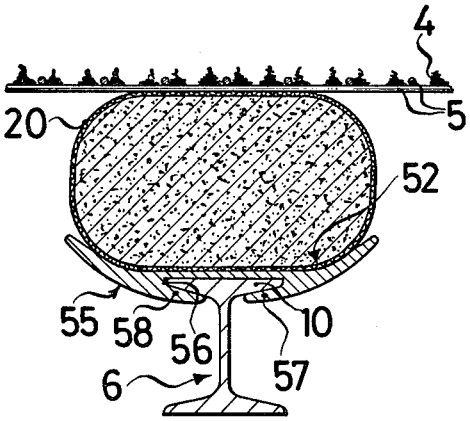
FIG. 7 shows a different exemplary embodiment of the invention in a view corresponding to FIG. 5.

In the embodiment according to FIG. 7, the butt straps or plates with the base plates 38 are replaced by centering plates 55, having the same function as the butt straps 37. The centering plates 55 are extruded plastic shaped sections with a trough 52 facing the rock formation 4, and a channel 56 on the bottom with converging ribs 57 and 58 embracing the upper flange 10 of the I-section beam 6. These centering plates 55 are clamped on and stay in place because of their tight fit on the I-section beam 6.

As these parts are inexpensive, they are not constructed to be recoverable, but they can also be used, as needed, on the relatively straight ends 33 and 34 of the arch. The material may be thermoplastic, but can also be epoxy resin, which, may be reinforced with fiberglass in the shaped section, if needed.

The embodiment shown in FIG. 8, uses, in addition to a support hose 2, a number of short hoses 60 and 61 to fill in corresponding hollow cavities or spaces 62 that have been formed along the circumference of the arch.

The embodiment according to FIG. 9, shows the construction of the short hose, 60 and 61. Each hose is made of a circular knitted hose length 63, which is sewed together at its ends with several cross seams, as shown at 64 and 65. A short distance from the cross seams 64 and 65, for instance, spaced about 30 cm., the material of the hose is subdivided at about its longitudinal center by short rows of stitching or locking seams 66 and 67. These rows of stitching may be about 70 mm long and may consist of four rows, as well as of two rows.

Figure 10:
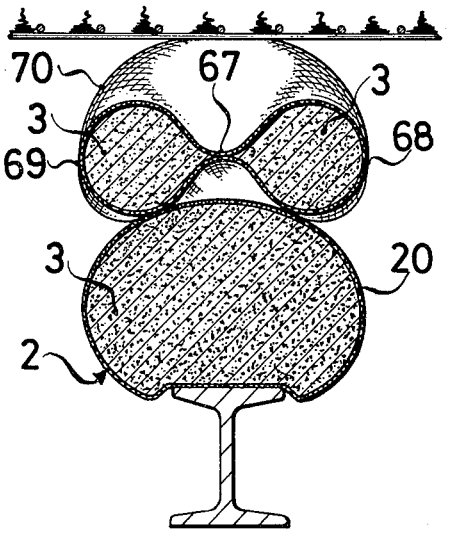
FIG. 10 shows a cross-sectional view taken along the line X—X of FIG. 9 with the short hose mounted atop the support hose as shown in FIG. 8.

As shown in FIG. 10, when the inflated profile 20 of the support hose 2 has been produced by injecting the hardening compound 3, the short hoses 60 and 61 can be filled. In the region of the locking seams 66 and 67, as shown in FIG. 10 on the example of the stitching 67, two longitudinal bulges 68 and 69 will form an inflated profile, which is designated as 70, is formed between the locking seams and the cross seams 64 and 65, and makes the contact with the rock. The longitudinal bulges 68 and 69 hold the short hoses 60 and 61 on the supporting hose when the latter is expanded to its inflated profile 20 to insure that the short hoses 60 and 61 are centered on the support plane 7 of the I-section beam roadway support.

Figure 11:
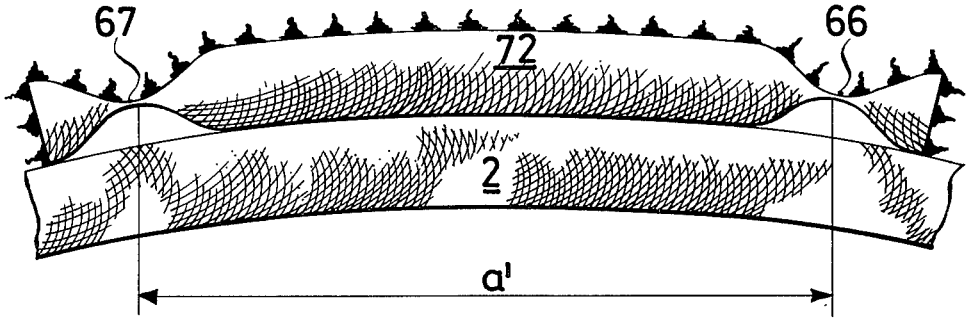
FIG. 11 is another exemplary embodiment in a partial view corresponding to FIG. 8.
Figure 12:
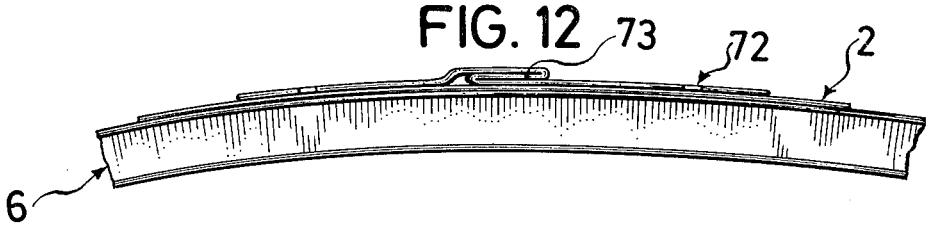
FIG. 12 is a partial view of the support hoses of FIG. 11 mounted to the roadway support before they are filled with the hardening filler.

The embodiment shown in FIGS. 11 and 12 is based on the assumption that the short hoses are of relatively short and precisely defined length between the stitching seams 66 and 67. The hose is constructed so that the initial length at the rows of the stitching seams 66 and 67 enlarges and assumes the value a' when filled with the hardener filler, enabling the short hose to be inflated to a thick bulge. To achieve this, the at first flat short hose, shown at 72, is folded at 73 as shown in FIG. 12. The fold provides the required spare material. As a matter of principle, the short hose is filled only after the support hose has been filled, that is, fully inflated.

The short hoses 61, 62 or 72 may consist of the same material as the support hose. Such a support hose is a circular knitted hose, which, for example, is designed for test pressures of up to 15 bar. The weaving of the material is accomplished such that the material acts as a filter, that is, fine grained filler substance is retained, but water can seep out of the woven material. Specifically, the capacity for completely retaining the binding agent of the preferably hydraulic filler compound is insured.

The fabric construction consists preferably of multi-filaments and is so made to prevent the individual fibers from shifting relative to each other. But individual openings in the fabric can be made with probes, the openings closing themselves upon removal of the probe through the outflow of the internal pressure, so that the hose can be filled at any place along its length. Generally, this type of hose consists of synthetic fibers. But a hose of blown foil, i.e. like the formation of foam plastic, with subsequent perforation, may also be considered.

The hose may also be designed to prevent distortion as it is placed onto the support section, particularly in the case of circular woven hoses. This may be accomplished by creases formed at the ends of the material in its flat state. These creases do not reduce the strength of the hose. The position of the hoses can also be predetermined by marking with a wrapped thread or by weaving a metal thread into the fabric, thereby facilitating the aligning of the hose on the support section.

The shape of the support, as used in the preferred embodiment, is an I-section beam in general terms only. It may also be designed as a cup, standard, rail, wide-flanged or box-section. Also sections of the so-called NCB-standard may be used.

This type of section is shown in FIG. 13 at 6. Its upper flange 10, facing the rocks, has a plurality of several round bolts or pins 87 preferably evenly spaced by a distance identified as b. These round bolts or pins 87 fit into the openings 86 of the support hose 88 shown in FIG. 14. The support hose 88 has two parallel cross-sectional flexible areas which are identified as 84 and 85. The cross-sections 84 and 85 are connected by a non-fillable woven region 83 with the openings 86 therein which may be reinforced by grommets. The outer edges 89 and 90 therein are also woven edges, so that the entire support hose 88 can be manufactured as one piece. The support hose can also be obtained from a larger unit by cutting along the outer edges 89 and 90.

For the embodiment shown in FIGS. 13 through 15 the roadway support structure is erected first. Then the hose is placed flush onto the upper flange 10 and form locked in placed, by placing the openings 86 onto the corresponding pins or round bolts 87. The hose is unrestrained on the upper flange 10 for its entire length 80.

When the support hose is filled under pressure at the flexible areas 84 and 85, it forms therein inflated profiles 91 and 92, respectively, which rest against the lagging 5, or against the rock formation 4 in the absence of lagging. Here, too, there is a partial indentation of the upper flange 10 into the inflated profiles 91 and 92, as shown in FIG. 15 at 21 and 22.

During the filling process, the hose may lift entirely or partially off of the pins 87 as the form-locking is attained, but the connection between 86 and 87 may also be secured against separating if desired.

Having described the invention, I claim:

1. An underground support structural device for supporting the concave roof formation of an excavated underground tunnel, said structural device comprising:

at least one convex beam support member mounted a predetermined distance from said concave roof formation, said at least one convex beam support member having a first outer surface substantially parallel to the neutral plane of said at least one convex beam support member along its entire length, said first outer surface facing said concave roof formation and defining a space between said concave roof formation and said first outer surface, said first outer surface of said at least one convex beam support member further being of a predetermined width;

a resilient support hose member mounted to said at least one convex beam support member, said resilient support hose member having a first portion of its outer periphery placed on said first outer surface of said at least one convex beam support member and extending into said space, said resilient support hose member further having a second portion of its outer periphery extending beyond said predetermined width of said at least one convex beam support member for at least a portion of its length; and a hardener filler compound located inside said resilient support hose member forming an inflated filler hose having an inflated profile filling the space between said first outer surface of said at least one convex beam support member and said concave roof formation and extending beyond said predetermined width and partly around said at least one convex beam, support member such that said inflated filler hose forms a bearing support for said concave roof formation and further forms a locking support in the lateral direction of said at least one convex beam support member and thereby supports said excavated underground tunnel.

2. The structural device as claimed in claim 1 further comprising:

secondary support means surrounding said at least one convex beam support member for a part of its length, said secondary support means having a body portion surrounding said at least one convex beam support member; a pair of free end portions attached to said body portion and extending above said first outer surface of said at least one convex beam support member into said space between member and said concave roof formation; and a frame structure adapted to support said secondary support means such that when said resilient support hose is filled with said hardener filler compound the support hose profile communicates with each of said pair of free end portions equally to thereby provide a secondary support for said inflated filler hose while said hardener filler compound cures to a permanent form.

3. The structural device as claimed in claim 1 wherein said at least one convex beam support member is an I-beam member having an outer flange facing the rock formation, an inner flange opposite to said outer flange and a web connecting said inner flange to said outer flange.

4. The structural device as claimed in claim 3 further comprising at least one butt strap attached to said outer flange of said I-beam member, said at least one butt strap having a first end portion extending laterally of said I-beam member and above said first outer surface of said I-beam member into said space defined between said first outer surface of said at least one convex beam support member and said concave roof formation; a second end portion opposite said first end portion, said second end portion extending laterally of said I-beam member and above said first outer surface of said at least one convex beam support member into said space defined between said first outer surface of said at least one convex beam support member and said concave roof formation; and means for attaching said at least one butt strap to said I-beam member such that when said resilient support hose is filled with said hardener filler compound the support profile communicates with said first and second end portions equally to form a bearing support for said inflated support hose.

5. The structural device as claimed in claim 1 wherein said at least one convex beam support member comprises at least two beam members attached to each other, and means for attaching said at least two beam members to each other so as to form a convex beam support structure.

6. The structural device as claimed in claim 1 wherein said resilient support hose member further comprises:

a first support hose member mounted to said at least one convex beam support member, said first support hose member having a first portion of its outer periphery placed on said first outer surface of said at least one convex beam support member and a second portion of its outer periphery straddling said predetermined width of said at least one convex beam support member for at least a portion of its length, said first support hose member further extending into said space towards said concave roof formation;

a second support hose member mounted to said first support hose member, said second support hose member having a first portion of its outer periphery mounted to said second portion of said outer periphery of said first support hose member, said second support hose member further having a second portion of its outer periphery juxtaposed said concave roof formation; and means for mounting said second support hose member to said first support hose member whereby said second support hose member forms at least two bulges straddling said predetermined width of said at least one convex beam support member for at least a portion of its length.

7. The structural device as claimed in claim 1 wherein said resilient support hose member further comprises:

a first inflatable hose portion;

a second inflatable support hose portion spaced a predetermined distance from said first inflatable hose portion;

means for attaching said first inflatable support hose portion to said second inflatable support hose portion, said attaching means further comprising means for securing said first and second inflatable hose portions to said at least one convex beam support member; and wherein said at least one convex beam support member is adapted to receive said means for securing, whereby said first and second inflatable support hose portions straddle said predetermined width of said at least one convex support beam member for at least a portion of its length to seal said space between said first outer surface of said at least one convex support beam member and said concave roof formation.

8. The structural device as claimed in claim 1 further comprising a lagging member interposed said concave roof formation and said first outer surface of said at least one convex beam support member.

9. A process for backfilling and supporting the concave roof formation of an excavated underground tunnel having a floor, said process comprising the steps of:

placing at least one convex support beam member a predetermined distance from said concave roof formation, said at least one convex support beam member resting on said floor and having a predetermined width and a first outer surface facing said rock formation, said at least one convex support beam member defining a space to be filled between said first outer surface of said at least one convex support beam member and said concave roof formation;

laying a first inflatable support hose into said space on said first outer surface of said at least one convex support beam member; and filling said first inflatable support hose with a hardening compound and inflating said first inflatable support hose with said hardening compound to form an inflated support hose having an inflated profile of said first inflatable support hose which fills said between said rock formation and said at least one convex support beam member and which further forms a straddling engagement beyond said predetermined width of said at least one convex support beam for a portion of its length to thereby lock said inflated support hose in place between said at least one convex support beam member and said concave rock formation of said excavated underground passage.

10. A process for backfilling and supporting the concave roof formation of an excavated underground tunnel having a floor, said process comprising the steps of:

placing at least one convex support beam member a predetermined distance from said concave roof formation, said at least one convex support beam member resting on said floor and having a predetermined width and a first outer surface facing said concave rock formation, said at least one convex support beam member defining a space to be filled between said first outer surface of said at least one convex support beam member and said concave roof formation;

laying a first inflatable support hose member into said space on said first outer surface of the at least one convex support beam member;

placing a temporary support structure adjacent said at least one convex support beam member, said temporary structure partially surrounding said at least one convex support beam member, said temporary support structure having a pair of free end portions, each of which extend laterally from the predetermined width of said at least one convex support beam member for supporting said first inflatable support hose member while said first inflatable support hose member is inflated with hardening compound; and filling said first inflatable support hose member with a hardening compound and inflating said first inflatable support hose member with said hardening compound to form an inflated support hose having an inflated profile of the first inflatable support hose member which fills said space between said concave rock formation and said at least one convex suppport beam member and which further forms a straddling engagement beyond said predetermined width of said at least one convex support beam member for a portion of its length to thereby lock said inflated support hose in place between said at least one convex support beam member and said concave rock formation of said excavated underground tunnel.

11. The process as claimed in claim 9 further comprising the steps of attaching at least one butt strap to said at least one convex support beam member prior to placing said at least one convex support beam member in said excavated tunnel said predetermined distance from said concave roof formation, said butt strap having end portions extending into said space between said concave roof formation and said first outer surface of said at least one convex support beam member.

12. The process as claimed in claim 9 further comprising the step of attaching a lagging to the concave roof formation prior to inflating said first inflatable support hose with said hardening compound.

13. The process as claimed in claim 9 further comprising the additional steps of:

laying a second inflatable support hose member into said space on said first inflatable support hose; member and filling said second inflatable support hose member with a hardening compound and inflating said second inflatable support hose member with said hardening compound to form an inflated profile of the second inflatable support hose member atop said first inflatable support hose member which completely fills the space between said concave rock formation and said at least one convex support beam member and which further forms a straddling engagement with said first inflatable support hose member across the predetermined width of said convex support beam member for a portion of its length to thereby lock said filled first and second inflatable support hose members in place between said convex support beam member and said rock formation of the excavated underground tunnel.

14. The underground support structural device of claim 1 wherein said excavated underground tunnel comprises a floor disposed below said concave roof formation and further wherein said at least one convex beam support member rests upon said floor.

15. The underground support structural device of claim 1 wherein said at least one convex beam support member comprises a first elongated portion and a flange extending outwardly into opposite directions from said first elongated portion, said flange having an outer surface facing said rock formation such that said resilient support hose member extends beyond the width of said flange and partly therearound when said hardener filler compound is inserted therein to cooperate with said at least one convex support beam member to form a locking support therebetween.

16. An underground support structural device for supporting the concave roof formation of an excavated underground tunnel, said structural device comprising:

at least one convex beam support member mounted a predetermined distance from said concave roof formation, said at least one convex beam support member having a first outer surface substantially parallel to the neutral plane of said at least one convex beam support member along its entire length, said first outer surface facing said roof formation and defining a space between said roof formation and said first outer surface, said first outer surface of said at least one convex beam support member further being of a predetermined width;

a resilient support hose member mounted to said at least one convex beam support member, said resilient support hose member having a first portion of its outer periphery placed on said first outer surface of said at least one convex beam support member and extending into said space, said resilient support hose member further having a second portion of its outer periphery extending beyond said predetermined width of said at least one convex beam support member for at least a portion of its length;

a hardener filler compound located inside said resilient support hose member forming an inflated hose having an inflated profile filling the space between said outer surface of said at least one convex beam support member and said concave roof formation and extending beyond said predetermined width and partly around said at least one convex beam support member, such that said inflated hose forms a bearing support for said concave roof formation and further forms a locking support in the lateral direction of said at least one convex beam support member and thereby supports said excavated underground tunnel;

secondary support means surrounding said at least one convex beam support member for a part of its length, said secondary support means having a body portion surrounding said at least one convex beam support member; a pair of free end portions attached to said body portion and extending above said first outer surface of said at least one convex beam support member into said space between said at least one convex beam support member and said concave roof formation; and a frame structure adapted to support said secondary support means such that when said resilient support hose is filled with said hardener filler compound the support hose profile communicates with each of said pair of free end portions equally to thereby provide a secondary support for said inflated support hose while said hardener filler compound cures to a permanent form.

17. The structural device as claimed in claim 16 wherein said at least one convex beam support member is an "I" beam having an outer flange facing said concave rock formation, an inner flange opposite to the outer flange and a web connecting said inner flange to said outer flange.

18. The structural device as claimed in claim 16 wherein said at least one convex beam support member comprises at least two beam members attached to each other, and means for attaching said at least two beam members to each other so as to form a convex beam support structure.

19. The structural device as claimed in claim 16 wherein said resilient support hose member further comprises:

a first support hose member mounted to said at least one convex beam support member, said first support hose member having a first portion of its outer periphery placed on said first outer surface of said at least one convex beam support member and a second portion of its outer periphery straddling said predetermined width of said at least one convex beam support member for at least a portion of its length, said first support hose member further extending into said space towards said concave roof formation;

a second support hose member mounted to said first support hose member, said second support hose member having a first portion of its outer periphery mounted to said second portion of said outer periphery of said first support hose member, said second support hose member further having a second portion of its outer periphery juxtaposed said concave roof formation; and means for mounting said second support hose member to said first support hose member whereby said second support hose member forms at least two bulges straddling said predetermined width of said at least one convex beam support member for at least a portion of its length.

20. The structural device as claimed in claim 16 wherein said resilient support hose member further comprises:

a first inflatable support hose portion;

a second inflatable support hose portion spaced a predetermined distance from said first inflatable support hose portion;

means for attaching said first inflatable support hose portion to said second inflatable support hose portion, said means for attaching further comprising means for securing said first and second inflatable support hose portions to said at least one convex beam support member; and wherein said at least one convex beam support member is adapted to receive said means for securing, whereby said first and second inflatable support hose portions straddle said predetermined width of said at least one convex beam support member for at least a portion of its length to seal said space between said first outer surface of said at least one convex beam support member and said roof formation.

21. An underground support structural device for supporting the concave roof formation of an excavated underground tunnel, said structural device comprising:

at least one convex beam support member mounted a predetermined distance from said concave roof formation, said at least one convex beam support member having a first outer surface substantially parallel to the neutral plane of said at least one convex beam support member along its entire length, said first outer surface facing said concave roof formation and defining a space between said concave roof formation and said first outer surface, said first outer surface of said at least one convex beam support member further being of a predetermined width;

a resilient support hose member mounted to said at least one convex beam support member, said resilient support hose member having a first portion of its outer periphery placed on said first outer surface of said at least one convex beam support member and extending into said space, said resilient support hose member further having a second portion of its outer periphery extending beyond said predetermined width of said at least one convex beam support member for at least a portions of its length;

a hardener filler compound located inside said resilient support hose member forming an inflated filler hose having an inflated profile filling said space between said first outer surface of said at least one convex beam support member and said concave roof formation and extending beyond said predetermined width and partly around said at least one convex beam, support member such that said inflated filler hose forms a bearing support for said concave roof formation and further forms a locking support in the lateral direction of said at least one convex beam support member and thereby supports said excavated underground tunnel;

a first support hose member mounted to said at least one convex beam support member, said first support hose member having a first portion of its outer periphery placed on said first outer surface of said at least one convex beam support member and a second portion of its outer periphery straddling said predetermined width of said at least one convex beam support member for at least a portion of its length, said first support hose member further extending into said space towards said concave roof formation.

a second support hose member mounted to said first support hose member, said second support hose member having a first portion of its outer periphery mounted to said second portion of said outer periphery of the first support hose member, said second support hose member further having a second portion of its outer periphery juxtaposed said concave roof formation; and means for mounting said second support hose member to said first support hose member whereby said second support hose member forms at least two bulges straddling said predetermined width of said at least one convex beam support member for at least a portion of its length.

22. The structural device as claimed in claim 21 wherein said at least one convex beam support member comprises at least two beam members attached to each other, and means for attaching said at least two beam members to each other so as to form a convex beam support structure.

* * * * *

UNITED STATES PATENT AND TRADEMARK OFFICE

CERTIFICATE OF CORRECTION

PATENT NO. : 4,465,405

DATED : August 14, 1984

INVENTOR(S) : Werner Durrfeld

It is certified that error appears in the above-identified patent and that said Letters Patent is hereby corrected as shown below:

Column 1, line 52, delete "sections there-" and insert ---- sections. There -----.

Column 2, line 44, after "plane" insert a comma ---- , ----.

Column 3, line 68, delete "described." and insert ---- described herein; ----.

In The Claims

Column 8, line 41, delete "beam, support member" and insert---- beam support member, ----.

Column 8, line 53, after "member;" insert a new paragraph indention.

UNITED STATES PATENT AND TRADEMARK OFFICE

CERTIFICATE OF CORRECTION

PATENT NO. : 4,465,405

DATED : August 14, 1984

INVENTOR(S) : Werner Durrfeld

It is certified that error appears in the above-identified patent and that said Letters Patent is hereby corrected as shown below:

Column 8, line 56, after "between" insert ---- said at least one convex beam support ----.

Column 10, line 35, before "between" insert ---- space ----.

Column 11, line 7, delete "the" and insert ---- said ----.

Column 11, line 34, delete "hose;" and insert ---- hose ----.

Column 11, line 35, after "member" insert a semi-colon ---- ; ----.

Column 13, line 49, after "said" insert ---- concave ----.

Column 14, line 15, delete "portions" and insert ---- portion ----.

Column 14, line 23, delete "beam, support member" and insert ---- beam support member, ----.

Signed and Sealed this

*Fourteenth* Day of *May 1985*

[SEAL]

*Attest:*

DONALD J. QUIGG

*Attesting Officer*

*Acting Commissioner of Patents and Trademarks*